US008900678B2

(12) United States Patent
Zeng et al.

(10) Patent No.: US 8,900,678 B2
(45) Date of Patent: Dec. 2, 2014

(54) COATED MEDIUM FOR INKJET PRINTING AND METHOD OF FABRICATING THE SAME

(75) Inventors: Xi Zeng, San Diego, CA (US); Jason Swei, San Diego, CA (US); Kali M. Campbell, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1084 days.

(21) Appl. No.: 12/475,350

(22) Filed: May 29, 2009

(65) Prior Publication Data

US 2010/0304057 A1 Dec. 2, 2010

(51) Int. Cl.
*B41M 5/52* (2006.01)

(52) U.S. Cl.
CPC ..... *B41M 5/5218* (2013.01)
USPC ..... 428/32.34; 427/146; 428/32.35; 428/32.37

(58) Field of Classification Search
CPC ..... B41M 5/5218
USPC ..... 428/32.34, 32.35, 32.37; 427/146
See application file for complete search history.

(56) References Cited

U.S. PATENT DOCUMENTS

| | | | | |
|---|---|---|---|---|
| 5,458,680 | A | 10/1995 | Shurling et al. | |
| 5,851,651 | A * | 12/1998 | Chao | 428/327 |
| 5,879,442 | A | 3/1999 | Nishiguchi et al. | |
| 5,882,396 | A | 3/1999 | Hiorns | |
| 5,985,424 | A | 11/1999 | Dematte et al. | |
| 6,074,474 | A * | 6/2000 | Broome et al. | 106/486 |
| 7,018,708 | B2 | 3/2006 | Song et al. | |
| 7,267,719 | B2 | 9/2007 | Lunden et al. | |
| 2003/0039808 | A1 * | 2/2003 | Ichinose et al. | 428/195 |
| 2003/0124222 | A1 | 7/2003 | Newkirk et al. | |
| 2003/0200702 | A1 * | 10/2003 | Lee et al. | 51/298 |
| 2004/0197496 | A1 * | 10/2004 | Song et al. | 428/32.25 |
| 2005/0098066 | A1 * | 5/2005 | Lunden et al. | 106/464 |
| 2005/0249922 | A1 * | 11/2005 | Zhou et al. | 428/195.1 |
| 2009/0017234 | A1 | 1/2009 | Song et al. | |

FOREIGN PATENT DOCUMENTS

WO WO 2007006796 A1 * 1/2007

* cited by examiner

*Primary Examiner* — Bruce H Hess

(57) ABSTRACT

A coated medium for inkjet printing is disclosed. The coated medium includes a coating layer formed on at least one side of a supporting substrate. The coating layer includes precipitated calcium carbonate with an average particle size of less than about 1 micron, silica with a surface area of greater than 100 $m^2/g$, a third inorganic pigment with an average particle size greater than that of precipitated calcium carbonate and selected from the group consisting of ground calcium carbonate (GCC) and clays, and at least one binder, wherein silica is present in an amount of at least 15 parts based on 100 parts of inorganic pigments in total.

19 Claims, No Drawings

COATED MEDIUM FOR INKJET PRINTING AND METHOD OF FABRICATING THE SAME

BACKGROUND

Some recent trends in the digital inkjet technology include the advancement of colorants in inks from dye molecules to pigment particles, and high-speed printing in the commercial or industrial printing business. Traditional coated papers for offset printing and other analog printing industries are not able to offer good image quality, print quality and/or durability when they are printed with inkjet printers. The medium or paper used in an inkjet printer determines the quality of the image printed.

DETAILED DESCRIPTION

In inkjet technology, the colorants in the inks are divided into two main groups: dyes and pigments. Dyes are small compounds soluble in water or organic solvents. After printing, dye molecules in an image could be degraded when exposed to light or chemicals in the environment, such as ozone or other hazardous chemicals. Hence, images based on dye inks are not very good for light-fade resistance and ozone-fade resistance. Also dye-based inks yield bad performance with regard to water resistance. In inkjet inks, especially aqueous inks, dye compounds are water soluble. When printed images are contacted with water or another surface with high moisture content, dye molecules in the images could be easily dissolved into the contacted water or transferred onto other surface areas, thereby, causing degradation of the image.

Comparing to dye-based inks, pigment inks usually yield better durability performance, mainly due to the chemical difference between these types of colorants. Pigments are big aggregates of smaller molecules, formed through either intermolecular physical interactions or chemical bonds. Pigment particles are very robust to light, water, solvents, and hazardous chemicals in the environment. When exposed to light or chemicals, the majority of pigment particles are kept intact even if the outside layer are eroded or degraded. As a result, the images printed with pigment inks are more durable.

When pigment inks are printed on traditional glossy, coated specialty media, such as glossy brochure papers or photo papers, pigment particles settle down at the top surface of the coating layer and form a film structure similar to filter cake. After printing, images on the printed media are generally susceptible to smearing under any one of a number of conditions, such as rubbing with dry or wet fingers, rubbing against other printed or blank sheets, and marking with a highlighter pen. Therefore, it is the ink pigment layer that is subjected to physical damage, whereas in the case of images printed with dye-based inks, it is the media coating layer that is subjected to damage because the dye molecules can easily penetrate into the coating layer, which is typically porous, and are protected by the media coating layer. As a result, it is a big challenge for images printed with pigment inks to be robust under the rubbing or smearing conditions discussed above. Among these conditions highlighter smear is a major concern, especially on glossy media, where there are no small pores or recesses on the smooth surface for pigments to anchor. When a printed image is marked by a highlighter, the pigment particles on the top surface undergo a shear force, and can be transferred by the pen tip. On the other hand, the liquid in the highlighter, which can be either acid-based or alkaline-based, could dissolve the binder in the pigment ink, soften the dried pigment layer, weaken inter-particle interactions and adhesion between pigment particles and coating layer, thereby resulting in pigment particles that are much easier to be rubbed off.

Inkjet technology has expanded its application to high-speed, commercial and industrial printing, in addition to home and office usage. Coated, glossy media are available for such inkjet printing to produce high gloss prints with high brightness and high image quality comparable to that of offset printing. It is desirable to make these coated, inkjet media low cost so as to enable inkjet printing in the new application to be cost-efficient and to compete with traditional analog printing or other digital printing technologies, like laser printing or liquid electrophotography. Traditional inkjet specialty media tend to be unsatisfactory for use with the new high-speed printers. In part, this is due to the large amount of relatively expensive materials, such as silica, alumina, boehmite, or mixtures of these, which are customarily used in the media coatings to affect image quality and printability. Although some available inkjet specialty media containing these materials may give good image quality and image permanence, their complicated manufacturing requirements and relatively high cost make the new high-speed inkjet printing noncompetitive with existing analog printing and laser printing methods.

In inkjet coated media, it is conventional to have an image-receiving layer (i.e., the layer onto which ink droplets are deposited) with small size particles with high surface area incorporated therein as the major pigment. Some examples include silica, alumina and other metal oxides, specialty calcium carbonate with high surface area, specialty aluminum silicate with high surface area, and the like. These pigments can provide a coating layer with fast absorption and enough capacity for inkjet printing. On the other hand, these pigments are more expensive, and as a result, coated papers based on these pigments are not very competitive when compared to similar grade products in traditional analog printing industries, or even coated media for digital printing with electrophotographic technologies. Another disadvantage is that, when coating formulations are based on these pigments with high surface area, their total solid content is usually low due to high water or solvent demands for pigment dispersion, for example, in the range from 20 wt % to 30 wt %. As a consequent, during the manufacturing of the coated media, a lot of energy is required to remove the water or solvent from the coating layer, thus, the coating speed is limited by the drying capability. This leads to high machine operating costs and an increase in the total cost of final products.

in order to compete with traditional analog printing or digital photographic printing, low-cost coated paper is one of the key elements to help inkjet technology to lower its total cost per page and broaden its applications in industrial printing. In order to develop low-cost coated inkjet papers, both the coating material cost and the manufacture operating cost need to be reduced. In the current coated paper industry, low cost coating pigments include precipitated calcium carbonate, ground calcium carbonate, kaolin clays, and others. Coating formulations based on these traditional pigments have low raw material costs. The formulations based on these low-cost pigments generally have a high solid content, usually in the range from 60 to 70 wt %. With such a high solid content, these formulations require much less energy to remove the water after coating and enable high coating speeds. As a result, the total manufacture operating expenses can be kept to a low level. However, coated papers based on these low-cost pigments usually have a relatively dense coating structure, especially when compared with inkjet coated paper based on pigments with high surface area. As a result, the absorption rate of such coated paper is slow, and its absorption capacity is not high enough to meet the requirements of inkjet printing. When such coated paper is printed using an inkjet printer, the printed paper suffers several shortcomings including slow drying time, high level of coalescence (graininess) in images, undesirable feathering patterns, print mottling, poor rub resistance and water resistance, to name a few.

Another issue associated with coatings containing pigments is runnability. The runnability of a paper coating formulation is influenced by many factors including its solid content and the viscosity of the coating composition. Runnability is well known to be influenced by the viscosity of the paper coating composition. On a commercial blade or rod coater, the coating layer is applied under very high shear from the blade knife or rod tip on the coater head. If the coating layer is not maintained at a sufficiently high viscosity under such high shear, it is difficult to keep the coating layer on the supporting media substrate and to obtain a desirable coat weight.

This disclosure provides a novel coating composition for glossy inkjet media. When the medium coated with this novel coating composition is used in inkjet printing with pigment-based inks, the printed medium imparts good image quality, including reduced print mottling and improved durability performance, especially highlighter smear resistance. Print mottling often presents as uneven, random color patterns in a large area of an image. It is generally believed that uneven absorption of ink vehicle in the coating layer causes this defect, a result of uneven coat weight/thickness on base paper, and/or variation of pore structure in the coating layer. The term "highlighter smear resistance" refers herein to the resistance of a printed image to smearing/blurring when stroked with a highlighter marker. The gloss, including both non-imaged media gloss and image gloss, is comparable to or higher than competitive print media products, such as brochure media used in offset printing or electrophotographic printing. At the same time, in order to compete with glossy, coated media for traditional analog printing or laser printing, the coated medium of the present disclosure is designed to use low-cost coating materials and can be manufactured at a relatively low cost.

The present disclosure additionally provides a method of making a glossy medium coated with the above referenced novel coating composition. The method of making this coated medium includes: providing a support substrate; coating at least one side of the substrate with the novel coating composition; optionally calendering the coated substrate; and drying the coated substrate.

The novel coating composition of the present disclosure is an aqueous composition containing a specific combination of three different inorganic pigments and at least one binder. The first pigment is precipitated calcium carbonate (PCC), the second pigment is a silica pigment or a combination of different silica pigments, and the third pigment is selected from ground calcium carbonate (GCC), clays, or pigments similar to PCC but with a different crystalline morphology. The amount of silica in the coating composition is at least 15 parts based on 100 parts of inorganic pigments in total. In one embodiment, the coating composition has a solid content of at least 45% by weight.

The first pigment in the coating composition is precipitated calcium carbonate (PCC) particles with a narrow size-distribution. Since a smaller size particle generally gives high liquid absorption rate, a narrow size-distribution of PCC particles with small particle size is preferred in the coating layer. In one embodiment, the PCC particle has an average particle size of less than about 1 micron, preferably about 400 nm or smaller. In preferred embodiments, the precipitated calcium carbonate is present in an amount ranging from 10 parts to 55 parts based on 100 parts of inorganic pigments in total.

To be compatible with inkjet printing, the coated media should have a fast absorption rate and a high absorption capacity. PCC can not satisfy these requirements by itself, as such, the second pigment which has a high surface area, is included in the coating composition. This second pigment is a silica pigment with a high surface area, preferably 100 $m^2$/gram or higher, more preferably 200 $m^2$/gram or higher, even more preferably 300 $m^2$/gram or higher. The silica pigment particle may have either a porous secondary structure of primary particles with small particle size, or many internal porous structures in each particle. Suitable materials for the second pigment include, but are not limited to, fumed silica, silica gel, colloidal silica, and precipitated silica. When a combination of two or more different silica pigments is used, the different silica pigments may have different particle sizes and/or different surface areas.

In addition to improving liquid absorption, the inclusion of silica particles with high surface area is also potentially beneficial with respect to other properties of the coated medium, especially durability performance. In representative tests, it was found that having silica in the coating layer improves dry rub resistance and reduces highlighter smear of the printed image. It was also found that the higher the amount of silica, the higher the rub resistance and highlighter smear resistance. When the silica amount exceeds a certain threshold, 15 parts based on 100 parts of inorganic pigments, significant improvement in durability is seen. On the other hand, when the amount of silica in the coating layer is increased too much, silica will just provide very limited improvement in durability. Moreover, high silica amount would significantly increase the coating materials cost because its cost is higher than the other pigments like PCC or clays. At the same time, higher silica amount would also result in lower solid content of the coating liquid because silica particles need large amounts of water to be dispersed in the coating liquid. Coating liquids with lower solid content require more energy to remove water during the coating process, and then slow down the coating speed. As a result, coating process costs will increase. Therefore, it is preferred that the total amount of silica (one or different types of silica pigments) in the coating composition be in the range of about 15 parts to 60 parts based on 100 parts of inorganic pigments, more preferably 15 parts to 35 parts.

As discussed above, different types of silica pigments may be used. One advantage of having a combination of different silica pigments is enhanced sheet gloss for the coated medium. In one embodiment, a combination of silica powder and silica slurry is used instead of silica either in powder or slurry form. Furthermore, the coating composition in this embodiment has a solid content of at least 45 wt %, preferably 50 wt % or higher, and a high Hercules viscosity of at least 70 cP at 4400 rpm, preferably at least 90 cP. The coating composition with such high solid content is designed to produce a final coating layer with a high coat weight of at least 20 gsm. The main advantage of using such powder/slurry combination is to enable the coating composition to be mixed at a high solid content. If only powder silica pigment is used, a lot of water is needed to disperse the silica pigment, and consequently, the final solid content of the coating layer is limited. When only silica slurry is used, the final solid content is also limited because the silica slurry is usually produced as a dispersion of 25-30 wt %. However, if both silica powder and silica slurry are used in the coating composition, lesser amount of silica powder is needed as compared to compositions with only silica powder. At the same time, the amount of water in the silica slurry facilitates the dispersing of the dry silica powder. Thus, a synergistic effect is created by having both a silica powder and a silica slurry in the coating composition to yield a high solid content.

The powder silica discussed above may be fumed silica or silica gel. Fumed silica pigment is composed of agglomerates of many non-porous particles of amorphous silica particles with particle size in the nanometer range (e.g. 5-20 nanometers), produced by high temperature hydrolysis of silicon tetrachloride. A silica gel pigment includes porous amorphous silica particles with internal small pores, and is usually manufactured from acid treatment of sodium silicate solution. When dry silica powder is included in the coating composition of the present disclosure, its amount is limited by the total amount of silica in the formulation, and also the solid content of the coating layer. A relatively high amount of dry silica powder is required to create pores in the final coating layer so as to enable fast absorption of solvents and other liquid components in inks. The silica slurry may be a stable dispersion of fumed silica, silica gel, or colloidal silica. In addition, the silica slurry may have a solid content in the range from 20 wt % to 35 wt %.

When a combination of silica powder and silica slurry is used, it is preferred to select a dry silica powder with a relatively large average particle size and a silica slurry containing silica particles with a relatively smaller average particle size. With such combination, the presence of silica powder of large particle size generates a lot of large pores in the final coating layer, thereby resulting in a high absorption for ink solvent. At the same time, the presence of the silica slurry with smaller particle size results in a uniform distribution of silica pigment in the coating layer, which in turn results in improved image quality including reduced print mottles. The average particle size of silica powder is preferred to be in the range of 1-20 μm, and more preferably, 2-10 μm. The silica slurry contains particles with average particle size in the range of 0.05-2 μm, preferably. 0.1-1 μm, more preferably, 0.2-0.5 microns. The weight ratio of silica powder to silica slurry may be in the range of 1:3 to 3:1.

The third pigment is a low cost pigment with an average particle size greater than that of the first PCC pigment and a different particle morphology. It has been discovered that the coating compositions containing only PCC and silica particles tend to form a relatively dense packing structure in the coating layer, especially when the amount of silica in the formulation is not high enough. As a result, the coated paper has limited capacity for ink absorption and is more prone to image defects. Hence, the presence of the third pigment disrupts the packing structure of the PCC and silica pigments, and creates voids that enhance the absorption of ink liquid during printing. The third pigment is selected from the group consisting of clays, including Kaolin clay, hydrated clay, calcined clay, ground calcium carbonate (GCC) and pigments similar to PCC but with a different crystalline morphology. For example, if the first PCC pigment has an aragonite morphology (orthorhombic crystal system with pseudo hexagonal aggregates), then the third pigment may be a PCC pigment with scalenohedral or prismatic morphology. As another example, the first PCC has a scalenohedral morphology and the second PCC is a rhombohedral pigment. In preferred embodiments, the third pigment is present in an amount ranging from about 15 parts to about 35 parts based on 100 parts of inorganic pigments. The average particle size of the third pigment is preferably in the range of 0.5-10 μm, more preferably in the range of 0.5-5 μm, and even more preferably in the range of 0.8-2 μm. In some embodiments, the size distribution of the third pigment particles is as narrow as that of the first PCC particles, and in some other embodiments the size distribution of the third pigment particles is broader than that of the first PCC particles. Based on the fact that calcium carbonate has low water retention properties, clay pigments are more preferred.

Optional Polymeric Pigment

The coating composition described above may also include, as an optional component, a polymeric co-pigment. Suitable polymeric co-pigments include plastic pigments (e.g., polystyrene, polymethacrylates, polyacrylates, copolymers thereof, and/or combinations thereof). Suitable solid spherical plastic pigments are commercially available from The Dow Chemical Company, e.g., DPP 756A or HS 3020. The amount polymeric co-pigment in the coating composition may be in the range of 1 part to 10 parts based on 100 parts of inorganic pigment.

Binder

The novel coating composition also includes one or more binders that may include, but are not limited to, polyvinyl alcohol and derivatives thereof (e.g. carboxylated polyvinyl alcohol, sulfonated polyvinyl alcohol, acetoacetylated polyvinyl alcohol, and mixtures thereof), polystyrene-butadiene, polyethlene-polyvinyacetate copolymers, starch, gelatin, casein, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly (vinyl pyrrolidone-vinyl acetate) copolymer, a poly(vinyl acetate-ethylene)copolymer, a poly(vinyl alcohol-ethylene oxide) copolymer, mixtures thereof, and others without restriction. In general, the binder is present in an amount sufficient to bind the inorganic pigments and to meet the requirements of runnability or durability. In preferred embodiments, the binder is present in an amount ranging from about 7.5 to 20 parts based on 100 parts of inorganic pigments.

Coating Additives

The coating formulations may also include other coating additives such as surfactants, rheology modifiers, defoamers, optical brighteners, biocides, pH controlling agents, dyes, and other additives for further enhancing the properties of the coating. The total amount of optional coating additives may be in the range of 0 to 5 parts based on 100 parts of inorganic pigments.

Among these additives, rheology modifier is useful for addressing runnability issues. Suitable rheology modifiers include polycarboxylate-based compounds, polycarboxylated-based alkaline swellable emulsions, or their derivatives. The rheology modifier is helpful for building up the viscosity at certain pH, either at low shear or under high shear, or both. In certain embodiments, a rheology modifier is added to maintain a relatively low viscosity under low shear, and to help build up the viscosity under high shear. It is desirable to provide a coating formulation that is not so viscous during the mixing, pumping and storage stages, but possesses an appropiate viscosity under high shear. Some examples of rheology modifiers that meet this requirement include, but are not limited to, Sterocoll FS (from BASF), Cartocoat RM 12 (from Clariant), Acrysol TT-615 (from Rohm Haas). The amount of rheology modifier in the coating composition may be in the range of 0.1-2 parts, more preferably, in the range of 0.1-0.5 parts.

Supporting Substrate

The supporting substrate, on which the coating composition is applied, may take the form of a media sheet or a continuous web suitable for use in an inkjet printer. The supporting substrate may be a base paper manufactured from cellulose fibers. More specifically, the base paper may be produced from chemical pulp, mechanical pulp, thermal mechanical pulp and/or the combination of chemical and mechanical pulp. The base paper may also include conventional additives such as internal sizing agents and fillers. The internal agents are added to the pulp before it is convened into a paper web or substrate. They may be chosen from conventional internal sizing agents for printing papers. The fillers may be any particular types used in conventional paper making. As a non-limiting example, the fillers may be selected from calcium carbonate, talc, clay, kaolin, titanium dioxide and combinations thereof. Other applicable substrates include cloth, nonwoven fabric, felt, and synthetic (non-cellulosic) papers. The supporting substrate may be an uncoated raw paper or a pre-coated paper.

The coating composition described above is applied to one side or both opposing sides of the supporting substrate. If the coated side is used as an image-receiving side, the other side, i.e. backside may not have any coating at all, or may be coated with other chemicals (e.g. sizing agents) or coatings to meet certain needs such as to balance the curl of the final product or to improve sheet feeding in printer. The double-side coated medium has a sandwich structure, i.e., both sides of the supporting substrate are coated with the same coating and both sides may be printed with images or text.

The coating composition of the present disclosure may be applied to the supporting substrate using any one of a variety of suitable coating methods, such as blade coating, air knife coating, metering rod coating, curtain coating, or another suitable technique. To get a low-cost coated medium for inkjet printing, it is necessary to have relatively low manufacturing costs in addition to formulation material costs. Therefore, it is preferred to use a low-cost coating method, such as blade coating or metering rod coating, and run the coating process at high speed. For a double-side coated medium, depending on the set-up of production machine in a mill, both sides of the substrate may be coated during a single manufacture pass, or alternatively, each side may be coated in separate passes. The coating composition according to the present disclosure can be applied onto a media substrate (e.g., paper) at high application speeds and has a good runnability as defined by the ability to apply the coating composition onto the media substrate and to obtain a defect-free coated medium with a desired coat weight.

After the coating step, the coated medium is then subjected to a drying process to remove water and other volatile components in the coating layer and the substrate. The drying means includes, but not limited to, infrared (IR) dryers, hot surface rolls, and hot air floatation dryers. After coating, the coated medium may be calendered to increase glossiness and/or to impart a satin surface. When a calendering step is incorporated, the coated medium may be calendered by an on-line or an off-line calender machine, which may be a soft-nip calender or a supercalender. The rolls in a calender machine may or may not be heated, and pressure is usually applied to the calendering rolls.

The following Examples will serve to illustrate representative embodiments of the present disclosure and should not be construed as limiting of the disclosure in any way. All parts are dry parts in unit weight unless otherwise indicated.

EXAMPLES

Example 1

Coating compositions A1 and A2 were prepared according to the formulations set forth in the following Table 1.

TABLE 1

| Coating formulation ID | A1 | A2 |
|---|---|---|
| 1st pigment: Opacarb A40 (PCC) | 60 parts | 60 parts |
| 2nd pigment Gasil 23F (silica gel) | 5 parts | 10 parts |
| 3rd pigment: Ansilex 93 (calcined clay) | 35 parts | 30 parts |
| Surfactant: Olin 10G | 0.3 parts | 0.3 parts |
| Binder: Acronal S728 | 11 parts | 11 parts |
| Rheology modifier: Sterocoll FS | 0.1 parts | 0.1 parts |
| pH controlling agent: KOH | 0.3 parts | 0.3 parts |
| Defoamer: Foamaster VF | 0.2 parts | 0.2 parts |
| Binder: Mowiol 40-88 | 0.5 parts | 0.5 parts |

Note:

Opacarb A40 = precipitated calcium carbonate (PCC) with median particle size of about 400 nm available from Specialty Minerals Inc.

Gasil 23F = silica gel powder with surface area of 349 $m^2/g$ available from PQ Corp.

Ansilex 93 = calcined clay with median particle size of 1.7 μm available from BASF Corp.

Olin 10G = poly(2-oxiranemethanol) nonylphenyl ether available from Arch Chemicals.

Acronal S728 = styrene acrylic latex available from BASF Corp.

Sterocoll FS = acrylic acid/alkyl acrylate copolymer available from BASF Corp.

Foamaster VF = antifoaming agent available from Cognis.

Mowiol 40-88 = polyvinyl alcohol available from Clariant.

Example 2

Coating compositions B1-B3 were prepared according to the formulations set forth in the following Table 2.

TABLE 2

| Coating formulation ID | B1 | B2 | B3 |
|---|---|---|---|
| 1st pigment: Opacarb A40 (PCC) | 45 parts | 30 parts | 10 parts |
| 2nd pigment: Cab-O-Sperse PG 002 (fumed silica) | 20 parts | 40 parts | 60 parts |
| 3rd pigment: Ansilex 93 (calcined clay) | 35 parts | 30 parts | 30 parts |
| Surfactant: Tegowet 510 (Evonik) | 0.3 parts | 0.3 parts | 0.3 parts |
| Binder: Acronal S728 (BASF) | 11 parts | 11 parts | 11 parts |
| Rheology modifier: Sterocoll FS | 0.1 parts | 0.1 parts | 0.1 parts |
| pH controlling agent: KOH | 0.3 parts | 0.3 parts | 0.3 parts |
| Defoamer: Foamaster VF | 0.2 parts | 0.2 parts | 0.2 parts |
| Binder: Mowiol 40-88 | 0.5 parts | 0.5 parts | 0.5 parts |
| Dispersant: Acumer 9300 | 0.2 parts | 0.2 parts | 0.2 parts |
| Plastic pigment: DPP 756A | 5 parts | 5 parts | 5 parts |

Note:

Cab-O-Sperse PG 002 = aqueous dispersion of fumed silica with particle surface area of 200 $m^2/g$ available from Cabot Corp.

Tegowet 510 = silicone-free nonionic surfactant from Evonik Insudstries.

Acumer 9300 = sodium salt of polyacrylic acid from Rohm and Haas.

DPP 756A = solid spherical plastic pigments from Dow Chemical Co.

Opacarb A40, Ansilex 93, Acronal S728, Sterocoll FS, Foamaster VF, Mowiol 40-88 are as defined in Example 1.

Example 3

Coating compositions C1-C4 were prepared according to the formulations set forth in the following Table 3.

TABLE 3

| Coating formulation ID | C1 | C2 | C3 | C4 |
|---|---|---|---|---|
| 1st pigment (PCC): Opacarb A40 | 50 parts | 45 parts | 40 parts | 35 parts |
| 2nd pigment (silica #1): Gasil 23F | 10 parts | 15 parts | 30 parts | 35 parts |
| 2nd pigment (silica #2): Sylojet A-25 | 10 parts | 10 parts | 10 parts | 15 parts |
| 3rd pigment (clay): Ansilex 93 | 30 parts | 30 parts | 20 parts | 15 parts |
| Surfactant: Tegowet 510 | 0.3 parts | 0.3 parts | 0.3 parts | 0.3 parts |
| Binder: Acronal S728 | 11 parts | 11 parts | 11 parts | 11 parts |
| Rheology modifier: Sterocoll FS | 0.1 parts | 0.1 parts | 0.1 parts | 0.1 parts |
| pH controlling agent: KOH | 0.3 parts | 0.3 parts | 0.3 parts | 0.3 parts |
| Defoamer: Foamaster VF | 0.2 parts | 0.2 parts | 0.2 parts | 0.2 parts |
| Binder: Mowiol 40-88 | 0.5 parts | 0.5 parts | 0.5 parts | 0.5 parts |
| Plastic pigment: DPP 756A | 5 parts | 5 parts | 5 parts | 5 parts |

Note:
Sylojet A-25 = silica slurry with particle surface area of 158 $m^2/g$ available from Grace Davison.
Opacarb A40, Gasil 23F, Ansilex 93, Acronal S728, Sterocoll FS, Foamaster VF, Mowiol 40-88 as defined in Example 1, and DPP 756A as defined in Example 2.

In Example 3, two different types of silica gels where used.

Comparative Example A (Silica Pigment Only)

A comparative coating composition A was prepared according to the following formulation:

Pigment: Orisil 200 (fumed silica with surface area of 218 $m^2/g$), 88.1 parts
Treatment agent: Locron P (aluminum chloride hydroxide) 4.2 parts
Treatment agent: Silquest A1100 (γ-aminopropyltriethoxysilane), 7.8 parts
Binder: Mowiol 40-88 (polyvinyl alcohol), 13 parts
Crosslinker. Boric acid, 0.28 parts
Plasticizer: Glycerine, 1 parts
Surfactant: Olin 10G, 0.3 parts In this comparative example, only silica was used as the inorganic pigment component.

Comparative Example B (Offset Coating Formulation)

A comparative offset coating composition B was prepared according to the following formulation:

Pigment: Opacarb A40 (PCC), 60 parts
Pigment, Ansilex 93 (calcined clay), 40 parts
Surfactant: Tegowet 510, 0.3 parts
Binder: Acronal S728 (styrene acrylic, latex), 11 parts
Binder: Mowiol 40-88 (polyvinyl alcohol), 0.5 parts
Plastic pigment, OPP 756A, 5 parts
Defoamer: Foamaster VF, 0.2 parts
Rheology modifier: Sterocoll FS, 0.1 parts
Dispersant: Acumer 9300, 02 parts
pH controlling agent: KOH, 0.3 parts In the comparative example B, no silica was used.

For each of the coating formulations in the above examples, the components were mixed together in a beaker using a normal bench stirring equipment and the stirring was kept overnight. In some formulations, water may need to be added to obtain the right solid contents. Each coating liquid was then coated onto a base paper by using a laboratory single-roller blade coater (from Euclid Coating Systems Inc.) at a coat weight of 20 grams per square meter (gsm). The base paper is a standard B size (11"×17") uncoated sheet with basis weight of 90 gsm. The coated paper samples were then dried by a normal heat gun. After drying, the coated paper samples were then calendered using two passes with a lab calender machine under a pressure of 3200 psi, at 130° F. temperature. The gloss level of the final sheets was measured using a "Micro gloss 75°", a gloss meter from BYK-Gardner. The paper samples were then printed on an HP CM8060 MFP with Edgeline technology (from Hewlett-Packard Corporation). Standard pigment inks for this printer were used, i.e., HP C8750A black ink, HP C8751A cyan ink, HP C8752A magenta ink,. HP C8753A yellow ink, and HP C8754A bonding agent ink. After printing, the image quality of the prints, including bleeding, coalescence, area color fill, and print mottle, was evaluated visually. Color gamut and black optical density (KOD) were also measured using an X-Rite transmission/reflection densitometer.

Smear resistance is measured in milli optical density (milli COD) and measures the smeared portion of the image outside of the originally printed sample image. In other words, smear resistance is tested by measuring the milli OD ("mOD") of the smeared trail, and not a reduction in optical density of the originally printed image. A higher value of mOD means more ink is smeared off. Thus, a lower value of mOD indicates improved smear fastness. The printed paper sheets were tested for smear resistance by using a Faber-Castell highlighter pen at 24 hours after printing. Using the X-Rite densitometer, the optical density (OD) in the blank areas adjacent to the printed image was measured to determine the amount of ink being transferred from the printed image to the blank (unprinted) areas by the highlighter pens. The CD data of the smeared ink by the highlighter pen, sheet gloss, color gamut, and KOD are shown in Table 4.

TABLE 4

| Sample ID | Sheet Gloss (75°) | Color Gamut | KOD | High-lighter Smear (mOD) 1 pass, 24 hours | High-lighter Smear (mOD) 2 passes, 24 hours |
|---|---|---|---|---|---|
| A1 | 67.6 | 389K | 2.04 | 125 | 411 |
| A2 | 50.3 | 363K | 2.21 | 59 | 208 |
| B1 | 71.8 | 426K | 2.21 | 61 | 193 |
| B2 | 70.0 | 402K | 2.06 | 21 | 78 |
| B3 | 68.8 | 388K | 1.96 | 3 | 21 |
| C1 | 69.3 | 417K | 2.18 | 50 | 204 |
| C2 | 57.1 | 400K | 2.15 | 51 | 106 |
| C3 | 48.9 | 392K | 2.10 | 59 | 62 |
| C4 | 49.1 | 382K | 2.00 | 59 | 59 |
| Comparative A | 47.1 | 378k | 1.84 | 22 | 47 |
| Comparative B | 72.9 | 423k | 2.19 | 385 | 458 |

As shown in Table 4, the inclusion of silica pigment in the multi-pigment coating formulations (A1-A2, B1-B3, C1 -C4) improves highlighter smear resistance as compared to the offset coating formulation without silica (Comparative B). Moreover, formulations B1-B3, C1-C4, which contains more than 15 parts of silica, result in a more preferred highlighter smear resistance than formulations A1 and A2, which contain less than 15 parts of silica. At the same time, coated samples based on formulations B1-B3, C1-C4 impart better sheet gloss, color gamult and KOD than the coated sample based on formulation with only silica pigment (Comparative A). In each of Examples 1-3, the higher the amount of silica in the multi-pigment formulation, the better the smear resistance. The testing results indicate that the coating formulations need a minimum amount of silica to impart an acceptable highlighter smear resistance.

Example 4

Coating Formulation D and comparative Formulation E were prepared according to the formulations set forth in the following Table 5.

TABLE 5

| Component | Chemical Name | Formulation D | Comparative Formulation E |
|---|---|---|---|
| PCC | Opacarb A-40; | 50 parts | 60 parts |
| Clay | Ansilex 93 | 30 parts | — |
| | Hydramatte | | 15 parts |
| Silica powder | Gasil 23F | 10 parts | 25 parts |
| Silica slurry | Sylojet A-25 | 10 parts | — |
| Binder #1 | Acronal S728 | 11 parts | 11 parts |
| Binder #2 | Mowiol 40-88 | 0.5 parts | 0.5 parts |
| Surfactant | Olin 10-G | 0.3 parts | 0.3 parts |
| Defoamer | Foamaster VF | 0.3 parts | 0.3 parts |
| Rheology modifier | Sterocoll FS | 0.1 parts | 0.2 parts |
| Dispersant | Acumer 9300 | 0.2 parts | — |
| Base | KOH | 0.5 parts | — |

Note:
Hydramatte = coarse delaminated clay from KaMin LLC.
Opacarb A40, Ansilex 93, Gasil 23F, Sylojet A-25, Acronal S728, Mowiol 40-88, Olin 10-G, Foamaster VF, Sterocoll FS, Acumer 9300 are as defined in Examples 1-3.

Each of the formulation was mixed at a pilot scale of 240 kg, and then coated onto a base paper on a pilot scale coater. The pilot coater includes a blade/rod station to meter coat weight. After coating station, the coated paper passed through an infrared dryer, a hot surface dryer, and a hot air flotation dryer to dry the coating and the base paper. After coated paper has been dried, the paper was rewound, and conveyed through a pilot super calender. A smooth rod was used to control coat weight. On the coating station, pressure was applied to the smooth rod. The coat weight was controlled by adjusting pressure on the rod and also by adjusting the line speed of the coater. Generally, high pressure reduces the amount of coating material formed on the base paper, and lower pressure helps to increase coat weight. Moreover, lower pressure helps to gain higher coat weight at faster coating line speed.

At a pilot scale of 240 kg Formulation D could be mixed at 53.3 wt % without any problem. At this solid content, Formulation D has a relatively low Brookfied viscosity of 1240 cP and a relatively high Hercules viscosity of 100.4 cP. As a comparison, Comparative Formulation E could only be mixed at 46.6 wt % due to the high amount of dry silica powder in this formulation. Even at such lower solid content, this comparative formulation had a Brookfield viscosity of 976 cP, and its Hercules viscosity was only about 47.8 cP. Formulation 4 could be easily applied at more than 20 gsm of coat weight on the pilot coater. When coated at a speed of 750 fpm, Formulation D yielded a coat weight of 23.4 gsm even when the pressure on the smooth rod was high, i.e., 2.5 bar. When coating speed slowed down to 600 fpm, Formulation D yielded a coat weight of 21 gsm at rod pressure of 1.0 bar. In contrast, for comparative Formulation E, a much higher coating speed and a lower rod pressure were required to get a relatively high coat weight. Even at a condition of pressure of 0.9 bar and coating speed of 1200 fpm, comparative Formulation E could only yield a coat weight of 12.8 gsm. Table 6 provides a summary of the coating conditions and resulting coat weights.

TABLE 6

| | Formulation D | Comparative Formulation E |
|---|---|---|
| Solid content (wt %) | 53.3 | 46.6 |
| Brookfield viscosity (cP) | 1240 | 976 |
| Hercules viscosity (cP) | 100.4 | 47.8 |
| Pressure on smooth rod (bar) | 1.0 | 0.9 |
| Coating line speed (fpm) | 600 | 1200 |
| Coat weight (gsm) | 21.0 | 12.8 |

In summary, the coated, glossy medium of the present disclosure imparts excellent image quality when printed with pigment-based inkjet inks and improved durability, especially highlighter smear. At the same time, the coated medium of the present disclosure incurs a lower manufacturing cost than conventional inkjet coated media.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of 1 part to 20 parts should be interpreted to include not only the explicitly recited concentration limits of about 1 part to about 20 parts, but also to include individual concentrations such as 2 parts, 3 parts, 4 parts, etc.

Although the present disclosure describes certain representative embodiments and examples, it will be understood to those skilled in the art that various modifications may be made to these representative embodiments and examples without departing from the scope of the appended claims.

What is claimed is:

1. A coated medium for inkjet printing, comprising:

a supporting substrate; and a coating layer formed on at least one side of the supporting substrate, the coating layer comprising:

a first inorganic pigment of precipitated calcium carbonate with an average particle size of 400 nm or smaller, the first inorganic pigment being present in an amount ranging from about 10 parts to about 30 parts;

a second inorganic pigment of silica with a surface area of greater than 100 $m^2/g$, the silica being present in an amount ranging from about 40 parts to about 60 parts based on 100 parts of inorganic pigments in total;

a third inorganic pigment with an average particle size greater than that of the first inorganic pigment, the third inorganic pigment being calcined clay having an average particle size ranging from 0.8 μm to 2 μm, the third inorganic pigment being present in an amount of about 30 parts based on 100 parts of inorganic pigments in total; and at least one binder;

wherein the coated medium exhibits improved highlighter smear resistance measured in milli optical density units (mOD) compared to an other coated medium comprising a coating layer including the first inorganic pigment, the second inorganic pigment, and the third inorganic pigment, and wherein the second inorganic pigment of the coating layer of the other coated medium is present in an amount that is less than 40 parts based on 100 parts of inorganic pigments in the coating layer of the other coated medium in total.

2. The coated medium of claim 1 wherein the silica has a surface area of 200 $m^2/g$ or higher.

3. The coated medium of claim 1 wherein the silica is fumed silica.

4. The coated medium of claim 1 wherein the coat weight of the coating layer is greater than 20 g/m$^2$.

5. The coated medium of claim 1 wherein the coating layer further comprises a rheology modifier in an amount of about 0.1 parts based on a total number of parts of the coating layer.

6. The coated medium of claim 1 wherein the supporting substrate is a paper substrate containing cellulose fibers.

7. A coated medium for inkjet printing, comprising:

a supporting substrate; and a coating layer formed on at least one side of the supporting substrate, the coating layer having been formed by an aqueous coating composition comprising:

(i) a first inorganic pigment of precipitated calcium carbonate with an average particle size of less than about 1 micron;

(ii) a second inorganic pigment consisting of a combination of silica powder and silica slurry, the silica powder including silica particles having an average particle size, ranging from 1 μm to 20 μm, that is larger than an average particle size, ranging from 0.1 μm to 1 μm, of silica particles in the silica slurry, and the silica slurry being a silica dispersion containing from 20 wt % to 35 wt % of silica based on a total wt % of the silica dispersion;

(iii) a third inorganic pigment with an average particle size greater than that of the first inorganic pigment and selected from the group consisting of ground calcium carbonate (GCC) and clays; and (iv) at least one binder;

wherein a solid content of the aqueous coating composition is at least 45 wt %.

8. The coated medium of claim 7 wherein the silica powder comprises a first silica gel, and the silica slurry comprises a second silica gel that is different from the first silica gel.

9. The coated medium of claim 7 wherein the silica powder includes silica particles having a surface area greater than 100 m$^2$/g, and the silica slurry includes silica particles having a surface area that is different from that of the silica particles of the silica powder.

10. The coated medium of claim 7 wherein the weight ratio of silica powder to silica slurry ranges from 1:3 to 3:1.

11. The coated medium of claim 7 wherein the coating layer includes about 10 parts of the silica powder and about 10 parts of the silica slurry based on 100 parts of inorganic pigments in total.

12. The coated medium of claim 7 wherein the coating layer has a coat weight of at least 20 gsm and a Hercules viscosity of at least 70 cP.

13. The coated medium of claim 7 wherein the coating layer has a Hercules viscosity of 50 cP or higher.

14. A method of fabricating a coated medium for inkjet printing, comprising:

(a) preparing an aqueous coating composition, comprising:

a first inorganic pigment of precipitated calcium carbonate with an average particle size of less than about 1 micron;

a second inorganic pigment consisting of a combination of silica powder and silica slurry, the silica powder including silica particles having an average particle size that is greater than the average particle size of silica particles of the silica slurry, and the silica slurry being a silica dispersion containing from 20 wt % to 35 wt % of the silica particles based on a total wt % of the silica dispersion;

a third inorganic pigment with an average particle size greater than that of the first inorganic pigment and selected from the group consisting of ground calcium carbonate (GCC) and clays; and at least one binder;

wherein a solid content of the aqueous coating composition is at least 45 wt %;

(b) applying the aqueous coating composition to at least one side of a supporting substrate to form a coated substrate;

(c) drying the coated substrate, thereby forming a coating layer from the applied aqueous coating composition; and (d) calendering the dried and coated substrate.

15. The method of claim 14 wherein the aqueous coating composition comprises, based on 100 parts of inorganic pigments in total:

from 10 parts to 55 parts of precipitated calcium carbonate;

from 15 parts to 60 parts of the combination of the silica powder and the silica slurry;

from 15 parts to 35 parts of a clay selected from the group consisting of Kaolin clay, hydrated clay, and calcined clay; and from 7.5 parts to 20 parts of the at least one binder.

16. The method of claim 14 wherein the aqueous coating composition has a Hercules viscosity of 50 cP or higher.

17. The method of claim 14 wherein the weight ratio of silica powder to silica slurry ranges from 1:3 to 3:1.

18. The method of claim 14 wherein the coat weight of the coating layer is greater than 20 g/m$^2$.

19. The method of claim 14 wherein the aqueous coating composition further comprises a rheology modifier in an amount ranging from 0.1 to 2 parts based on a total number of parts of the coating layer.

* * * * *